US008455057B2

(12) United States Patent
Heiskanen et al.

(10) Patent No.: US 8,455,057 B2
(45) Date of Patent: Jun. 4, 2013

(54) METHOD FOR CONTROLLING SURFACE CONTACT AREA OF A PAPER OR BOARD SUBSTRATE

(75) Inventors: Isto Heiskanen, Imatra (FI); Kaj Backfolk, Imatra (FI)

(73) Assignee: Stora Enso Oyj, Helsinki (FI)

( * ) Notice: Subject to any disclaimer, the term of this patent is extended or adjusted under 35 U.S.C. 154(b) by 202 days.

(21) Appl. No.: 12/438,492

(22) PCT Filed: Aug. 24, 2007

(86) PCT No.: PCT/FI2007/000211

§ 371 (c)(1), (2), (4) Date: Jul. 29, 2009

(87) PCT Pub. No.: WO2008/023092

PCT Pub. Date: Feb. 28, 2008

(65) Prior Publication Data

US 2010/0015460 A1 Jan. 21, 2010

(30) Foreign Application Priority Data

Aug. 24, 2006 (FI) ..... 20060756

(51) Int. Cl.
*B05D 1/04* (2006.01)

(52) U.S. Cl.
USPC ..... 427/466; 427/483; 427/485

(58) Field of Classification Search
USPC ..... 427/475, 485, 466, 483
See application file for complete search history.

(56) References Cited

U.S. PATENT DOCUMENTS

| | | | | | |
|---|---|---|---|---|---|
| 4,103,053 | A | * | 7/1978 | Barehas | 428/41.6 |
| 4,748,043 | A | * | 5/1988 | Seaver et al. | 427/482 |
| 4,779,558 | A | * | 10/1988 | Gabel et al. | 118/46 |
| 5,223,473 | A | * | 6/1993 | Oliver et al. | 503/226 |
| 6,969,540 | B2 | | 11/2005 | Seaver et al. | |
| 2002/0160120 | A1 | | 10/2002 | Bermel et al. | |
| 2005/0123678 | A1 | | 6/2005 | Maijala et al. | |

FOREIGN PATENT DOCUMENTS

| | | | | |
|---|---|---|---|---|
| EP | 0 982 120 | A1 | | 3/2000 |
| JP | 11-300862 | A | | 11/1999 |
| JP | 2000-190620 | A | | 7/2000 |
| JP | 2004-527370 | A | | 9/2004 |
| JP | 2005-519741 | A | | 7/2005 |
| WO | WO-92/22016 | A1 | | 12/1992 |
| WO | WO-02/090206 | A1 | | 11/2002 |
| WO | WO-03/076083 | A1 | | 9/2003 |
| WO | 03/076717 | | * | 9/2004 |
| WO | 2005/003460 | | * | 1/2005 |
| WO | WO-2005/003460 | A1 | | 1/2005 |
| WO | WO-2006/060815 | A2 | | 6/2006 |
| WO | WO-2006/090006 | A1 | | 8/2006 |

* cited by examiner

*Primary Examiner* — Frederick Parker
(74) *Attorney, Agent, or Firm* — Birch, Stewart, Kolasch & Birch, LLP

(57) ABSTRACT

Method for controlling contact area of a paper or board substrate or a product thereof, by depositing electrostatically a trace amount of particles comprising boundary lubricants to form one or more layers on the surface of the substrate. The boundary lubricants are deposited to the target surface solubilized or dispersed in a suitable solvent or carrier. The particles comprise an agent providing one or more effects selected from: lyophilicity, lyophobicity, hydrophobicity, hydrophilicity, lipophilicity, lipophobicity, oleophobicity, oleophilicity, and boundary lubrication. Also, a paper or board substrate treated according to the foregoing method. The use of electrostatic deposition of coating materials described herein gives improved control on contact and surface characteristics.

24 Claims, 3 Drawing Sheets

METHOD FOR CONTROLLING SURFACE CONTACT AREA OF A PAPER OR BOARD SUBSTRATE

CROSS-REFERENCE TO RELATED APPLICATIONS

This application is the U.S. national phase of international application PCT/FI 2007/000211, filed Aug. 24, 2007. Priority is claimed to Finnish application 2006-0756, filed Aug. 24, 2006.

FIELD OF THE INVENTION

The invention relates to a method for controlling surface contact area and compressibility of a paper or board substrate to surfaces or liquids. The invention also relates to a paper or board substrate treated according to the said method and to the use of electrostatic depositing of coating materials to control the surface properties and hence adhesion or wetting properties.

BACKGROUND OF THE INVENTION

In packaging industry, the properties needed for different applications may be diverse. The package may be required to form airtight, aseptic and mechanically durable sealing to protect the packaged product throughout its route from factory to market. This is essential for food. On the other hand, the same package should be easy to handle and open by the end consumers of the goods. To fulfil every requirement, compositions with several layers of the same or different materials are often used. Different layers serve different purposes, e.g. visual, barrier, carrier, tearing, sealing, etc. For manufacturing such multilayer compositions, typical processes are coating, laminating, extrusion coating and coextrusion.

Coating a substrate, i.e. a paper or board web, with a coating agent, has been typical refinement in production of high-quality surfaces. The coating process is performed either in connection with the paper-making machine, as an on-line process, or as a separate off-line process. In an on-line process, the continuous web having been formed in the paper-making machine runs directly to the coating machine, and the web is wound only after the coating process steps. In off-line coating, the web is wound after the paper-making machine and this web is coated in a separate coating machine by seaming a new roll after each web unwound from the preceding roll.

There is a range of different options available for the coating unit: air-knife, blade coaters, size press coaters, spray coaters, curtain coaters, electrostatic coating methods etc. The common feature for all these coating units is application of an aqueous coating paste over the entire width of the dry web, followed by drying of the coating paste and the partly wetted web by means of driers, such as infrared radiators, air blow driers or cylinder driers. The coating paste typically has a solids content of the order of 40 to 70%, while pigmented formulations used in flims press or size press treatments runs with lower solid content. Typical coating formulations in traditional coating include e.g. kaolin and calcium carbonate, minerals, binders, rheology modifiers and additives. The coating process may be repeated a number of times to achieve a surface with excellent performance. Such a combination may comprise e.g. coating of both sides of the web, first with a size press coater and subsequently coating of both sides with a blade coater. Calendaring usually follows coating to achieve appropriate gloss and smoothness for the surface. Then the web is formed as a "machine roll", which, in turn, is divided in a winder into rolls with smaller width and web length adapted to a printing machine.

When considering substrates for printing, the requirements for coating layers are related to uniformity, smoothness, gloss, colour, opacity, surface energy, retention, colour adsorption, etc. In case of coating formulations for board used to package food products and like, the FDA approval and consent to odour and taste requirements are crucial, which often eliminates the use of wide-ranging class of functional chemicals. In case of print quality related to wetting and adhesion, the most common way to control the interactions are via modification of the surface energy. Traditional coating methods and agents, the aim has traditionally been to improve adhesion. Said methods can be surface treatment, mechanical roughening, removing weak boundary layers, minimising stresses, using adhesion promoters, using suitable acid-base interactions, as well as providing favourable thermodynamics and using wetting. Typical treatment techniques include the use of chemicals such as primers and solvents, the use of heat and flame, mechanical methods, plasma, corona treatment and radiation. Each technique can improve adhesion via different influences. Desired effects include promoting adhesion between the substrate and the coating by increasing the free energy (wettability) of the surfaces, inducing chemical reaction between them, and removing bond weakening impurities from them.

In case of too strong adhesion between dissimilar or similar layered materials various lubricants and on the other hand, powders such as talc can be introduced to reduce surface energy or contact between the materials. Contacts may be between solid and solid or between solid and liquid. Although these substances facilitate the processing, their presence in or on the end product surfaces may be undesirable, even prohibited, as is the case with food. Problems within traditional coating methods arise from different requirements for surfaces during different phases of the life cycle of the package. During production, on the production line, the units should flow liquidly, but during transport, too slick surfaces may cause drifting of the load with collisions and breaking of the packages.

SUMMARY OF THE INVENTION

The main purpose of the invention is to provide a method for influencing surface properties of substrates.

The invention also has the purpose of improving the material efficiency of packages so as to provide high quality though using fewer resources: less material and energy than before. The possibility to apply coating controllably, only to desired positions and as adjusted amounts, guides to minimised coating agent consumption.

Another purpose of this invention is to achieve a more efficient and economical method for producing durable and reliable paper or board substrates or products thereof.

The invention is based on the idea that the surface contact area surface can be controlled by electrostatic deposition of a trace amount of particles on the said surface of the substrate. Said particles form a layer having characteristics contributing to surface properties of the treated product. What is desired is control of e.g. adhesion and wetting, and wetting rate via applying a thin layer coating on surface. In case of adhesion, starting material can be low or high surface energetic but with the said process it is possible to gradually attain certain degree of adhesion. By partial coverage of a material between the substrate A and substrate B with a material C, adhesion can be increased or decreased depending on the reference condition. Without being bound to a theory, it is believed, that the thin coating layer also overlaps local cavities in the matrix and therefore promotes better contacts. In case of wetting, the fibres can entrap air in the structure and hence create hydrophobic or super-hydrophobic structures. The applied materials can also be liquid absorptive and hence either dissolve or swell with different rates and thus retard the wetting process. In the latter case, the said functional fibre can also be made chemical specific to bound e.g. colorants in the surface allowing solvent to wet laterally or vertically.

When trying to solve problems related to prior art, the inventors have now found that in contrast to existing techniques such as flexographic or spray coating with primer solution or corona or flame treatment, the present invention introduces a method for applying a morphological difference to the surface. Flexography provides total or partial coverage starting from polymer, dispersion or emulsion solution, in which drying mainly occurs on the substrate and material/solvent migrates on the substrate. A similar case can be related to traditional spray treatment. In both cases, changes in morphology promote better contact. In case of corona or flame, the modification occurs directly on the substrate with little impact on surface morphology. In the method of present invention, when using e-spinning or e-spray, the chemical is in the form of a fibre or droplet-fibre providing both morphological and chemical modifications. Drying starts already during the transfer onto the substrate.

Most preferred is to have high immobilization providing very low or negligible penetration of particularly the chemical but also the solvent and thus leaving evaporation to air as the most energetically favourable drying method.

A product obtained following the idea of the invention is a paper or board substrate comprising a layer formed by electrostatic deposition of particles on the substrate surface.

Further, the according to the invention, the method described above can be used to impinge on substrate surfaces in different applications. In other words, electrostatic deposition of a trace amount of particles on a surface of a substrate may be used to control contact of said surface of said substrate to other surfaces.

BRIEF DESCRIPTION OF THE SEVERAL VIEWS OF THE DRAWINGS

The invention is further illustrated with following figures.

DETAILED DESCRIPTION OF THE INVENTION

The applicants have now surprisingly found that by depositing electrostatically a trace amount of particles which form a layer on a surface(s) of paper or board substrates, the surface contact area of a substrate to another surface may be controlled. In contrast to traditional surface treatment, such as mineral coating, coverage is significantly less and penetration depth negligible.

With particles is here meant droplets, fibres or chained droplets. Typically they may comprise ordinary coating agents or suitable lubricants or polymers.

Figure 1:
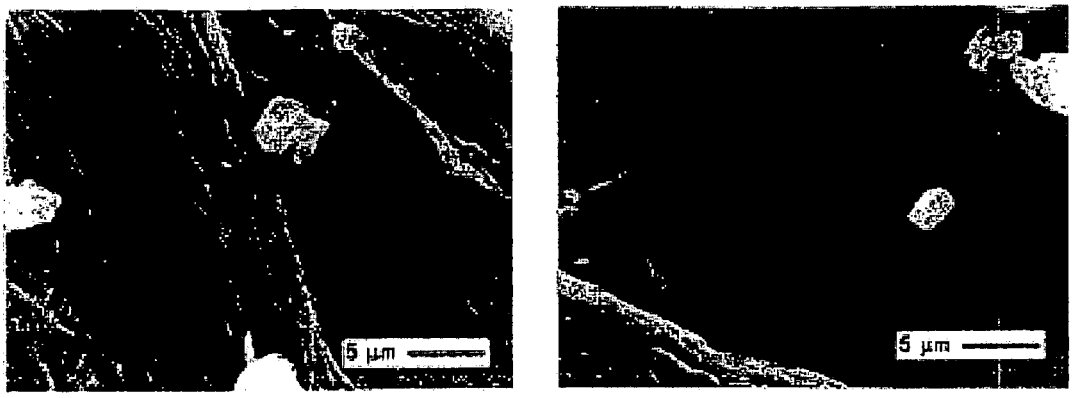
FIG. 1 represents SEM pictures of surfaces electrostatically sprayed with calcium stearate. Small particles with the diameter of approximately 2-5 microns represent here calcium stearate. Magnification is ×3500 and coat weight is 0.1 g/m$^2$ (FIG. 1A) and 0.01 g/m$^2$ (FIG. 1B)
Figure 2:
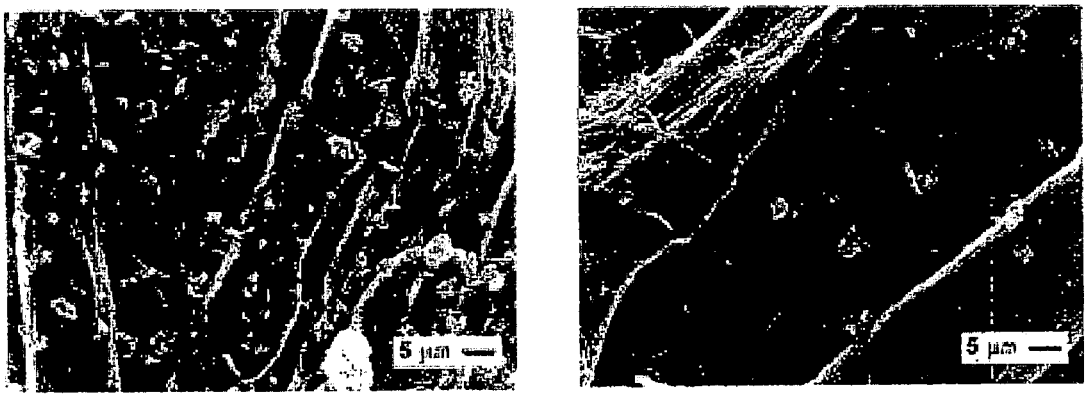
FIG. 2 represents SEM pictures of surfaces electrostatically sprayed with AKD-wax. The magnification is ×1500. Coat weights are again 0.1 g/m$^2$ (FIG. 2A) and 0.01 g/m$^2$ (FIG. 2B).
Figure 3:
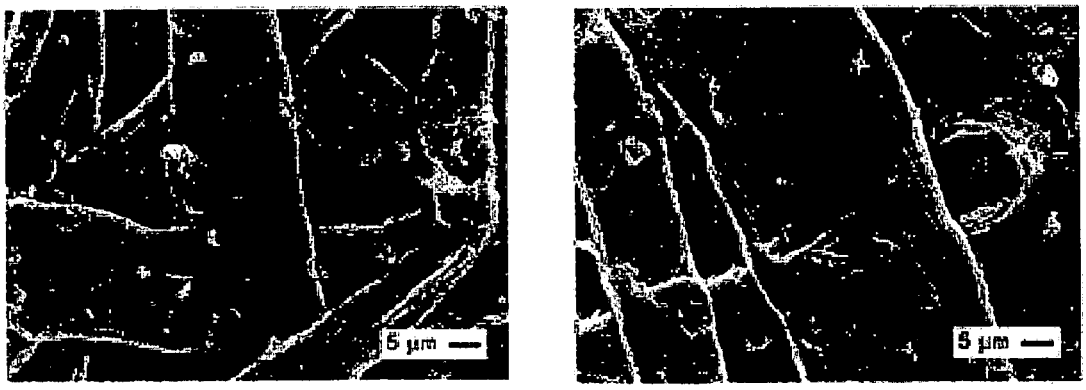
FIG. 3 represents SEM pictures of paperboard surfaces electrostatically sprayed with mixture of AKD/PCC. Magnification here is ×1500. Coating agent is applied to the substrate as coat weight of 0.1 g/m$^2$ (FIG. 3A) and 0.01 g/m$^2$ (FIG. 3B).

Said particles settle on the charged tops of the cellulose fibres leaving the cavities between separate cellulose fibres untouched. As the particles meeting the surface a relatively dry, they do not permeate into the gaps in the topology, but rather form a layer which is in contact with the extensions of the structure. In embodiments of the invention, it needs not to be continuous or unbroken. Contrarily, in the framework of the present invention, best results are obtained with mesh-like (e-spin) or scattered (e-spray) deposition of particles. As generally understood, a layer is a formation of particles, fibres or spheres in the direction of surface to be treated. A layer can consist of multiple layers in a layer. Here an example of a layer formed of spheres can be seen e.g. in SEM-picture in FIG. 2.

When in contact, these coated protrusions are the first to meet the other surfaces. As the outmost protrusions are now coated with particles, the contact area between said two surfaces is treated according to the present invention. Particles can be weakly bound to the treated surface, immobilized, and produce circumstances to support the contact. Depending on the desired effect, e.g. chosen among boundary lubricants the particles can promote smooth sliding by supporting the load between surfaces. Another example is change of contact angle with water, which may be effected by coating the substrate surface electrostatically with wax.

Figure 4A:
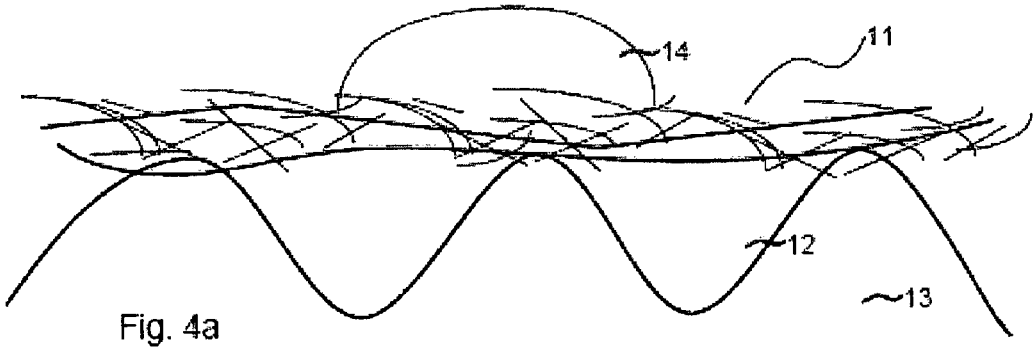
FIG. 4*a* shows a schematic representation of particles as fibres applied according to present invention (11) settling on cellulose fibre surface (13), avoiding the cavities (12), and a water droplet (14) on this surface
Figure 4B:
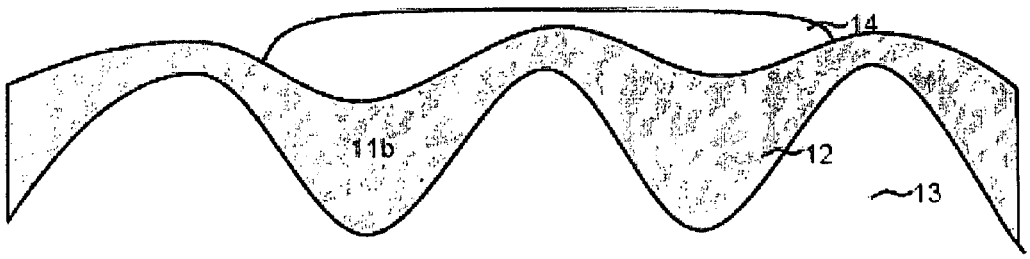
FIG. 4*b* is a comparative example of distribution of traditional wet coating (11*b*) of fibre surface topography (13), penetrating also into cavities (12), and a water droplet (14) on said coating surface.
Figure 5:
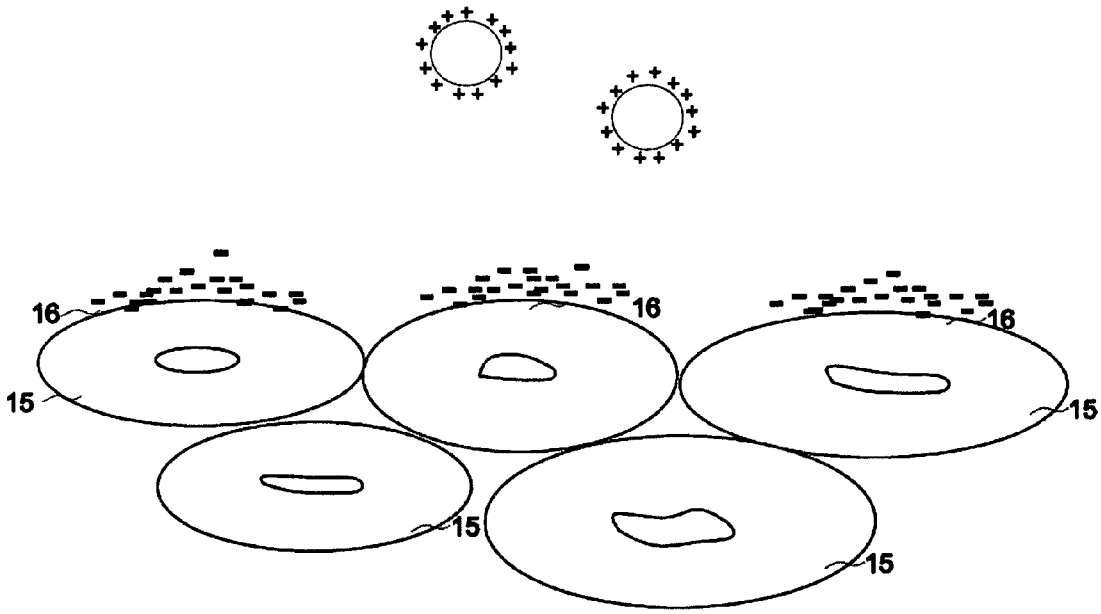
FIG. 5 shows schematically the charge distribution on cellulose fibres (15), where the negative charge is at its highest on the surface (16)
Figure 6A:
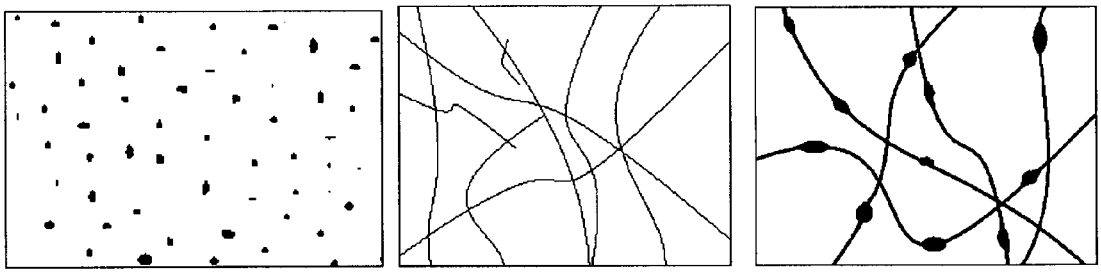
FIG. 6 gives schematic morphologies of particles *a*) droplets, *b*) fibres and *c*) chained droplets
Figure 7A:
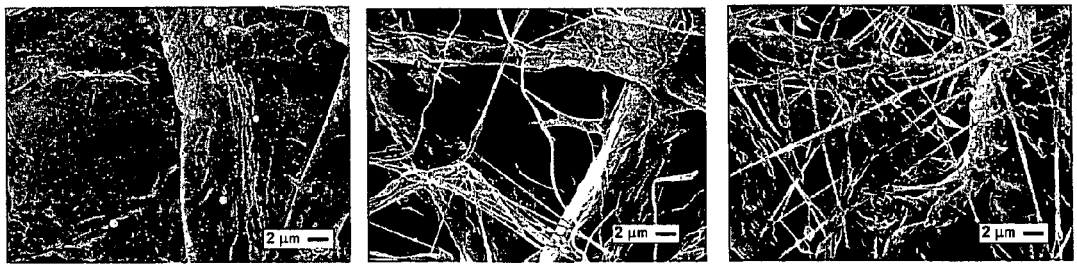
FIG. 7 shows the same morphologies as FIG. 6 in SEM pictures with magnification of ×3500.

Here, with controlling the contact of a substrate surface to another surface is meant the phenomena related to adhesion, cohesion, friction, etc. Controlling the surface contact area is here described e.g. by hydrophilic, hydrophobic, lyophilic, lyophobic, lipophilic, lipophobic, oleophobic or oleophilic nature of a surface of paper or board substrate. Understandably, two or more of these characteristics may be present at the same time. It is also believed to be related to topological and charge distribution characteristics of the substrate surface, as illustrated in FIGS. 4 and 5, and their exploitation when controlling the contact. One measure now studied is defining the contact angle with water of a surface of a substrate. This characteristic has been seen to have effect on sliding or friction between surfaces, sticking together without or under pressure.

The surface contact area of a substrate to another surface is controlled by depositing an amount ranging from 0.00001 to about 1.0 g/m$^2$ of particles on the surface of the substrate. The depositing may be direct or indirect. Indirect depositing comprises first depositing the particles on a carrier, such as a roll, and then transferring it on the substrate surface.

Electrostatic coating methods can be divided into three methods: electrostatic spraying and electrospinning, typically from solution under a DC field, as well as dry coating with powders using AC fields. By means of electrostatic coating, the desired coating weight can easily be achieved. Additionally, less available marcoscale-sites on uneven substrate surfaces are conveniently reached by the electrostatic coating techniques.

In electrospinning or electrostatic spraying applications the solvent or carrier is often partly or totally evaporated before the particles reaches the substrate surface to be coated. The particles do not form a smooth and uniform layer on the surface, but rather forms particles may morphologically be described as pearls or spheres, droplets, chained or connected droplets, fibres etc. These particles have small surface contact area with the substrate, which can bee seen in schematic FIG. 4. Without being bound to a theory, this phenomenon is believed to be influenced by charge distribution in cellulose fibre structure as represented roughly in FIG. 5. In FIG. 4*a* the effect of fibres and/or droplets of particles (11) on the surface of paper or board substrate (13) is schematically speculated. When the particles are deposited onto said surface, it prefers the outermost peaks of the uneven surface profile, leaving the cavities (12) unfilled with said particles. Instead, air is captured in these cavities (12). In certain applications, this air diminishes friction and thus protects the surface (13) from tension during contact with another substrate or e.g. a moulding cast.

In the method of invention, the particles comprise relatively small amount of solvent when contacting the target surface. Therefore, the fibres and droplets "pile" on the crests of cellulose fibres rather than the cavities (12). As a comparison, in FIG. 4*b* is shown how a common solvent, e.g. water has strong tendency to spread on the substrate surface, and though cover and smooth the surface profile with coating agent. It is important to note that, in the case of FIG. 4*b*, the coating agent is still suspended or solved when meeting the surface to be coated. The solvent is for one part evaporated and for another part absorbed into the cellulose fibres and other surroundings, when coating is dried.

FIG. 5 sketches the local charges guiding fibres and/or droplets of coating agent towards outermost peaks of the cellulose fibres. The positively charged coating agent (11), as relatively solvent-free particles, has tendency landing towards local negative charge of the fibre crests (16). Cavities (12) appear less tempting, even repulsive to said particles. As the solvent evaporates during flight from nozzle to substrate surface, the charge density increases and electric influences gain more determinant role.

Unexpectedly, this feature can be utilized when the contact between the surface of the substrate and another surface needs to be adjusted, especially when it is to be weakened locally. One embodiment of the invention is controlling the strength of a sealing, when said sealing is intended to be torn or peeled open. It is believed that the weak contact between electrostatically sprayed or electrospun coating chemicals break up the adhesion in a controlled manner and the seal is more easily torn up. Another application is the decreasing friction when press-moulding paper-cups. In this application, the electrostatic coating methods provide means for applying coating agents in trace amounts that are acceptable even for food packages. Additionally, the coating applied according to the invention, may be applied locally, only where needed for the friction fighting and adjusting, which further decreases the total amount of the coating on the surface of the substrate. It has also been found that amounts even this small can protect the raw-edges of the blanks cut from a package material sheets which may be subjected to contamination or humidity and absorb liquids before reaching the end user.

According to one embodiment of the invention, the substrate is a package, where a seal is adjusted to be opened by tearing. The package with this kind of sealing may have single or several equal parts joined together by a uniform or two of more separate seals. It could also contain unequal elements that share compatible surfaces to be sealed together. Typical examples are food or condiment packages for consumers, which are torn open when consumed. These include, but are not restricted to, yoghurt cups, coffee milk portions, chocolate bar wrappings etc. This embodiment can be further refined by controlling the coating locally. The site-directed coating can be applied by controlling the electric field to be variable according to the location. Another option is to shield majority of the substrate allowing the coating to contact selected target areas of the substrate. The shield usable here is a sheet of material impenetrable for the coating agent.

As said above, in the method of the invention, the surface contact area of a substrate is controlled by depositing electrostatically a thickness ranging from about 0.0001 to about 1.0 $g/m^2$ of particles on the surface of the substrate. Carried out in this manner, a surface is produced with appreciable efficiency and economy, which is capable of providing adjusted adhesion between the particles and the substrate surface.

In the spraying process, a high voltage electric field applied to the surface of a liquid causes the emission of fine charged droplets. The process is dependent on among other things, mass, charge and momentum conservation. Therefore, there are several parameters, which influence the process. The most important parameters are the physical properties of the liquid, the flow rate of the liquid, the applied voltage, the used geometry of the system, and the dielectric strength of the ambient medium. The essential physical properties of the liquid are its electrical conductivity, surface tension and viscosity. An electrospray apparatus is typically formed of a capillary, pressure nozzle, rotating nozzle, or atomizer, which feeds the coating liquid, and a plate collector, which carries the substrate to be coated. An electrical potential difference is connected between the capillary and the plate.

The potential difference between the plate and the end of the capillary supplying the coating liquid is several thousands volts, typically dozens of kilovolts. The emitted droplets are charged and they may be neutralized if necessary by different methods. Their size varies, depending on the conditions used.

Electrospinning, just as electrospraying, uses a high-voltage electric field. In addition to solidified droplets like in electrospraying, solid fibres are also formed from a polymer melt or solution, which is delivered through a millimeter-scale nozzle. The resulting fibres, droplets and/or chained droplets are collected on a grounded or oppositely charged plate. With electrospinning, fibres can be produced from single polymers as well as polymer blends.

Electrospinning can be used to produce ultra-fine continuous fibres, the diameters of which range from nanometers to a few micrometers. The small diameter provides small pore size, high porosity and high surface area, and a high length to diameter ratio. The resulting products are usually in the non-woven fabric form. This small size and non-woven form makes electrospun fibres useful in varied applications.

In a spinning process various parameters affect the resulting fibres obtained. These parameters can be categorized into three main types, which are solution, process and ambient parameters. Solution properties include concentration, viscosity, surface tension, conductivity, and molecular weight, molecular-weight distribution and architecture of the polymer. Process parameters are the electric field, the nozzle-to-collector distance, nozzle geometry, number of nozzles, air/gas pressure and the feed rate. Ambient properties include temperature, humidity and air velocity in the spinning chamber.

In the following, the most important technical features of the invention are disclosed. The claimed process relates to a method for controlling adhesion of a surface of a substrate by electrostatic deposition of a trace amount of particles on the said surface of said substrate. It is especially desirable to decrease the contact and deliberately weaken bonding between the layers of multilayered paper or board products, reduce friction or otherwise prevent surfaces from sticking together.

The depositing may be direct or indirect. When depositing directly, the particles leaves the spraying nozzle, meets the substrate surface to be coated and settles on it. In the indirect method, the particles are first deposited on a carrier and then transferred on the substrate surface from the said carrier.

The electrostatic depositing of a trace amount of particles on the said surface of the said substrate provides the desired result, especially when the agent is a boundary lubricant. These compounds include some native or synthetic lubricants, waxes, soaps, adhesives and others. Experimentally studied coating agents comprise modified or unmodified starch, styrene/acrylate, styrene/butadiene, styrene/acrylonitrile or adhesives such as AKD (alkyl ketene dimer), ASAS, resin adhesive or different lubricants such as calcium stearate, organic triglycerides, polyethylene glycol, polyethylene oxide, polyethylene and different pigments, such as calcium carbonate, kaolin, starch, silica, bentonite, etc, optical brighteners and colorants and mixtures thereof. The said coat weight deposited on the substrate can vary ranging from 0.00001 to 1.0 g/m$^2$, preferably from 0.0001 to 0.5 g/m$^2$. Even smaller total measures are achieved, when only part of the measured area is deposited, i.e. the coating is adjusted locally or by increasing web speed at the same productivity in mass per second. This can be done by varying the voltage or by shielding the substrate surface partially.

As described here, the preferred substrate is preferably a precursor or finished paper or board, or a product thereof. A preferred type of substrate is cellulose or wood containing <300 g/m$^2$ of non-coated or coated board (garde) produced by means of normal wet paper processes. Typically, the applications require multilayered substrate, which advisably has as the outer surface a moisture resistant layer, such as plastic. By paper is meant any felted or matted sheet containing as an essential constituent cellulose fibres. The products processed thereof may be webs or sheets cut to fit the particular use or any three-dimensional products of material mentioned earlier.

The multilayered substrate coated according to this invention may optionally be formed by first depositing the trace amount of the particles on a selected layer or a combination of layers that is/are further merged with yet another or other layers by processes known in the art. The particles deposited according to this invention, may remain on one of the surfaces of the finished substrate or as processed between the layers.

With the paper substrates the coating could be deposited on-line on a paper-making machine or as a part of or as an separate off-line process. The possible sub-processes on-line where the deposition could take place are after calandering and before rolling. For off-line processes, appropriate positions include roll opening, cutting of blanks, before or after printing, just prior to the moulding or possibly before or after package filling.

In the method of the invention, the electrostatic deposition may be electrostatic spraying, whereby the particles are in the form of liquid droplets or particles dispersed in the gas phase. Then the liquid droplets form a solution, an emulsion or dispersion of the coating agent in a solvent or emulsion medium.

Another option is that the electrostatic deposition is electrospinning, whereby at least a part of the primer is in the form of fibres dispersed in the gas phase. The fibres are formed from a solution or an emulsion or dispersion of the primer material in a solvent or emulsion medium. The solvent is selected from aqueous solvent systems and preferably contains water or a mixture containing water and an alcohol.

For the purposes of the invention, the electrostatic voltage used is between 1 and 500 kV, preferably between 10 and 50 kV, and the distance between the primer source and the substrate is between 100 and 1000 mm, preferably between 200 and 500 mm, most preferably so that the electric field is between 1 and 4 kV/cm.

Paper or board substrate treated according to method described above has several valuable characteristics. The amount of the particles is tailored to fit both processing and the end use. Even when treated according to the invention the substrate may possess segments that have no coating on and on the other hand segments with tailored trace amounts of selected coating on. It may even possess on its surface or between layers various coatings deposited specifically on different segments.

The method of the invention can be used for electrostatical deposition of a trace amount of particles on a surface of a substrate to control contact of said surface of said substrate to another surface. One embodiment is controlling adhesion of said surface. Preferably the use aims at decreasing the adhesion/weakening the contact. The particles used are beneficially of a boundary lubricant.

One embodiment of the invention is to deposit boundary lubricants on paper or board substrate surfaces. These compounds as powders, are known and widely used in many fields. The compounds include for example calcium stearate, magnesium stearate and talc. According to the method and use of the invention, these compounds are deposited to the target surface solubilized or dispersed in a suitable solvent instead of traditional fine powder. The lubricant concentration remaining on the substrate is considerably lower and the application can be adjusted only and precisely to the chosen targets.

Boundary lubrication occurs when a fluid fails to develop into a complete fluid film, i.e. hydrodynamic lubrication, allowing occasional contact between high points, known as asperities, of sliding wear surfaces. Examples when this may occur are during equipment start up or shut down, when bearing may operate in boundary rather than full fluid film conditions, or in tooth gear contact or reciprocating wear (possibly car valve on value seat).

By boundary lubricants are here referred to surface-active molecules, which form vertically oriented layers on substrate surfaces and support the load between two such surfaces during sliding. Friction is then determined by the interactions between the layers, which are weaker than the interactions between the substrate surfaces and thus give a lower friction. This means that the ability of a surfactant to decrease friction depends on its molecular orientation on the surface. The tendency to form vertically oriented layers improves with increasing chain length of the surfactant due to the stronger cohesion between the chains. The resistance to wear of a layer depends on the packing density of the individual surfactant molecules and this also increases with increasing length of the hydrocarbon chain ($C_{18}$-$C_{20}$). Structural irregularities in the hydrocarbon chain of a surfactant, such as kinks due to double bonds in unsaturated fatty acids disturb the order of the layer and decrease its stability. Preferably the boundary lubricant is selected from $C_{15}$-$C_{21}$ unsaturated fatty acids or lactone derivates or metallic salts or soaps thereof.

Long-chain linear hydrocarbons with a polar head-group, such as long-chain saturated fatty acids and long chain fatty alcohols with more than 15 carbon atoms in the carbon chain and sterols from wood, are efficient lubricants of paper surfaces because they can form ductile molecular films on the surfaces and thereby act as boundary lubricants. Especially suitable boundary lubricants to lower paper-to-paper friction are low-molecular-mass lipophilic compounds (LLC) occurring in wood, pulp and paper.

Practical examples of this embodiment include the moulding of a paper or board blank into a tray. Here it is the friction reduced at chosen targets that enhance moulding performance. Corresponding effect is equally useful for processing liquid cartons, such as milk cartons during the formation of the desired package shape. In this embodiment, the substrate is a mould blank wherein the deposition of the particles decreases the friction during moulding said blank into said mould usable as a food package. Preferably is deposited on cut raw edge of a mould blank wherein the coating prevents absorption into the packaging material.

A specific embodiment of the invention is to use the invention to control adhesion of release papers, which are described as follows. Release papers have target to keep adhesive or sticky material free from dirt and other impurities. Release papers are used as backing paper for self-adhesive labels. These grades are also used for packing sticky materials and as casting papers. Hence, the substrate may be a release paper or a label paper.

Specially, for packing sticky materials and even food, invention gives clearly a benefit with lower friction and less sticking that gives improved release properties. The beneficial properties show e.g. as load support during compression.

With label paper is meant here paper designed to be affixed to another piece of paper or another object, typically by the action of a layer of adhesive back of the label.

EXPERIMENTAL

Polymer surfaced papers (PE, PP, PET) were coated with different chemicals with e-spin, e-spray and spray treatments. The coating agents used were starch, styrene/acrylate, styrene/butadiene, styrene/acrylonitrile or adhesives such as AKD (alkyl ketene dimer), ASAS, resin adhesive or different lubricants such as calcium stearate, organic triglycerides, polyethylene glycol, polyethylene oxide, polyethylene and different pigments, such as calcium carbonate, kaolin, starch, silica, bentonite, etc, optical brighteners and colorants and mixtures thereof. The coating was applied on the polymer surface of the substrate or on the opposite side as an amount of 0.0001 to 1.0 g/m$^2$.

Typical parameters for electrostatic spraying are shown in table 1. These include Brookfield viscosity [cPa], electric field [kV] and distance between the nozzle and the coated sample.

TABLE 1

Parameters for electrostatic spraying.

| Coating agent | Viscosity [cP] | Field ± [kV] | Distance [mm] |
|---|---|---|---|
| Calcium stearate/PEO mixture | 170 | 20 | 400 |
| AKD-wax blended with ethanol | about 600 | 30 | 300 |
| AKD/PCC (50/50) | About 500 | 40 | 400 |

The surfaces coated by electrostatic spraying are presented in figures. The poor adhesion is visible as the coating agent particles have relatively weak contact to the substrate. The coating agent has deposited as particles or fibres or discontinuous films, rather than forming continuous films or uniform layer(s) on the coated surface. The results of electrostatic spraying and electrospinning were relatively similar.

The dispersion of calcium stearate was successfully transferred to the substrate with the different techniques. Low treatment temperatures reduced the blossom and melting of the particles though precise control of preferred areas on the substrates.

Application Example

Moulded Paperboard Trays

Trays for food packages were manufactured of polymer layered paperboard, by first cutting blanks and then pressing them between moulds to form cups. Four coating agents were tested for their ability to reduce friction between the mould and the blank. Success in fighting friction results with better moulding, increased production speed, less tearing and lower number of partially or completely broken trays. In this experiment, a lubricant was applied according to the invention on the surface of the corners or both the corners and edges of the readily cut blanks. The friction decreasing agent was solubilized. The application was performed with electrospinning apparatus.

TABLE 2

Tray forming results

| Trial point | Treatment area | Heavily broken trays | Partially broken trays |
|---|---|---|---|
| No treatment | — | 11% | 89% |
| Ca-stearate 0.01 g/m$^2$ | Corners and edges | 0% | 0% |
| Ca-stearate 0.1 g/m$^2$ | Corners | 50% | 50% |
| Ca-stearete 0.1 g/m$^2$ | Corners and edges | 0% | 0% |
| AKD 0.01 g/m$^2$ | corners | 0% | 23% |
| AKD 0.01 g/m$^2$ | Corners and edges | 0% | 6% |
| AKD 0.1 g/m$^2$ | Corners | 0% | 23% |
| AKD 0.1 g/m$^2$ | Corners and edges | 0% | 8% |
| AKD + PCC 0.01 g/m$^2$ | Corners | 0% | 24% |
| AKD + PCC 0.01 g/m$^2$ | Corners and edges | 0% | 12.5% |
| AKD + PCC 0.1 g/m$^2$ | Corners | 6% | 24% |
| AKD + PCC 0.1 g/m$^2$ | Corners and edges | 8% | 17% |

The results show increased moulding for trays coated with calcium stearate or AKD-wax. The results of this experiment also encourage adding the friction decreasing agent also to the edges of the blank in addition to the corners to ensure desired moulding.

Only the mixture of AKD-wax and talc did not perform as wanted when applying a coating by electrospinning. Said mixture finished off as very uneven surface and therefore was not suitable for coating. Calcium stearate added to the hydrophilicity of the blank. Contrarily, AKD-wax contributed to the lubrication as did also the mixture of AKD/PCC. With the latter, the coat weight 0.01 g/m$^2$ had practically no effect to the contact angle with water. The hydrophobicity as a characteristic of contact was measured from samples treated according to method of invention. The measured contact angles for different coatings and for different coat weights are presented in table 3.

TABLE 3

Effect on surface reactivity.

| | Coat weight [g/m$^2$] | Contact angle with water [°] |
|---|---|---|
| Reference (No treatment) | — | 89.68 |
| Ca-stearate | 0.01 | 86.95 |
| Ca-stearate | 0.10 | 85.01 |
| AKD-wax | 0.01 | 93.38 |
| AKD-wax | 0.10 | 100.18 |
| AKD/PCC | 0.01 | 89.54 |
| AKD/PCC | 0.10 | 97.69 |

List of Abbreviations used in Figures

11 deposited particles
12 cavity on the surface
13 surface profile of a paper or board substrate
14 a water droplet
15 cross cut cellulose fibre
16 negatively charged crest of a cellulose fibre

The invention claimed is:

1. Method for controlling adhesion or wetting properties of a surface contact area of a paper or board substrate or a product thereof, said method comprising the steps of:
providing boundary lubricants in liquid form; and
depositing said boundary lubricants in liquid form electrostatically to form a layer(s) of a trace amount of particles comprising said boundary lubricants directly on a target area of said surface contact area, wherein said trace amount ranges from 0.00001 to 1.0 g/m$^2$.

2. Method according to claim 1 wherein said particles are deposited in an amount ranging from 0.0001 to 0.5 g/m$^2$.

3. Method according to claim 1 wherein said particles support the load between said surface and another similar or dissimilar surface during sliding.

4. Method according to claim 1 wherein said particles support the load between said surface and another similar or dissimilar surface during compressing.

5. Method according to claim 1 wherein said surface contact area is between solid and liquid.

6. Method according to claim 1 for controlling adhesion, wherein said surface contact area is between a surface of a paper or board substrate and a solid.

7. Method according to claim 1 wherein said layer(s) are weaker than the interactions between the paper or board substrate and the surface with which it is in contact.

8. Method according to claim 1 wherein the electrostatic deposition is selected from electrospinning and electrospraying.

9. Method according to claim 1 for controlling adhesion, wherein the contact between the substrate surface and another surface is weakened so that adhesion between them is decreased.

10. Method for controlling adhesion or wetting properties of a surface contact area of a paper or board substrate or a product thereof, said method comprising the steps of:
providing boundary lubricants in liquid form; and
depositing said boundary lubricants in liquid form electrostatically to form a layer(s) of a trace amount of particles comprising said bondary lubricants directly on a target area of said surface contact area, wherein said trace amount ranges from 0.00001 to 1.0 g/m$^2$,
where the boundary lubricant is selected from $C_{15}$-$C_{21}$ unsaturated fatty acids and lactone derivates and metallic salts and soaps thereof.

11. Method according to claim 10, wherein said particles are deposited in an amount ranging from 0.0001 to 0.5 g/m$^2$.

12. Method according to claim 10, wherein said particles support the load between said surface and another similar or dissimilar surface during sliding.

13. Method according to claim 10, wherein said particles support the load between said surface and another similar or dissimilar surface during compressing.

14. Method according to claim 10, wherein said surface contact area is between solid and liquid.

15. Method according to claim 10, wherein said surface contact area is between a surface of a paper or board substrate and a solid.

16. Method according to claim 10, wherein said layer(s) are weaker than the interactions between the substrate and the surface with which it is in contact.

17. Method according to claim 10, wherein the electrostatic deposition is selected from electrospinning and electrospraying.

18. Method according to claim 10, wherein the contact between the substrate surface and another surface is weakened so that adhesion between them is decreased.

19. Method for controlling adhesion or wetting properties of a surface contact area of a paper or board substrate or a product thereof by weakening the contact between said surface and another substrate, said method comprising the steps of:
providing boundary lubricants in liquid form; and
depositing said boundary lubricants in liquid form electrostatically to form a layer(s) of a trace amount of particles comprising said boundary lubricants on a target area of said surface contact area, wherein said trace amount ranges from 0.00001 to 1.0 g/m$^2$.

20. Method according to claim 19, wherein said particles are deposited in an amount ranging from 0.0001 to 0.5 g/m$^2$.

21. Method for controlling adhesion properties of a seal area of a paper or board package, said method comprising the steps of:
providing boundary lubricants in liquid form; and
depositing said boundary lubricants in liquid form electrostatically to form a layer of a trace amount of particles comprising said boundary lubricants on said seal area of said paper or board package, wherein said trace amount ranges from 0.00001 to 1.0 g/m$^2$,
whereby a seal located in said seal area of said paper or board package can be opened by tearing.

22. Method according to claim 21, wherein said particles are deposited in an amount ranging from 0.0001 to 0.5 g/m$^2$.

23. Method for controlling adhesion properties of a seal area of a paper or board package, said method comprising the steps of:
providing boundary lubricants in liquid form; and
depositing said boundary lubricants in liquid form electrostatically to form a layer of a trace amount of particles comprising said boundary lubricants on a cut raw edge of a blank, wherein said trace amount ranges from 0.00001 to 1.0 $g/m^2$.

24. Method according to claim 23, wherein said particles are deposited in an amount ranging from 0.0001 to 0.5 $g/m^2$.

* * * * *